United States Patent [19]

Leigh-Hunt

[11] 4,155,195

[45] May 22, 1979

[54] TOY AIRPLANE

[76] Inventor: Desmond Leigh-Hunt, 2017 Alameda Padre Serra, Santa Barbara, Calif. 93103

[21] Appl. No.: 794,217

[22] Filed: May 5, 1977

[51] Int. Cl.[2] ..... A63H 27/00

[52] U.S. Cl. ..... 46/74 R; 244/11

[58] Field of Search ..... 46/76 R, 78, 74 R, 124; 244/11, 22

[56] References Cited

U.S. PATENT DOCUMENTS

| | | | |
|---|---|---|---|
| 986,364 | 3/1911 | Compton | 244/11 |
| 1,031,623 | 7/1912 | DeColombier | 46/74 R |
| 1,758,178 | 5/1930 | Slinn | 46/74 R |
| 2,182,406 | 12/1939 | Ogsbury et al. | 46/74 R |
| 2,814,907 | 12/1957 | Sears | 46/78 |
| 3,728,814 | 4/1973 | Ruston | 46/74 R |

FOREIGN PATENT DOCUMENTS

| | | | |
|---|---|---|---|
| 26326 | 12/1963 | German Democratic Rep. | 46/78 |

*Primary Examiner*—Russell R. Kinsey
*Assistant Examiner*—Mickey Yu
*Attorney, Agent, or Firm*—Jack C. Munro

[57] ABSTRACT

A toy airplane which is to be constructed of two pairs of overlapping wings which are to flap relative to each other. Each pair of wings is to move in synchronism with respect to the fuselage. The flapping motion of each wing is driven by a crank arm which is attached to a drive shaft. The different crank arms are located in planes which are displaced ninety degrees from each other so as to smooth out the operating torques. There may be employed a single operating drive shaft or there may be employed dual drive shafts which rotate in opposite directions. The airplane includes a tail section which is adjustably mounted upon a fuselage.

10 Claims, 11 Drawing Figures

Fig. 1.
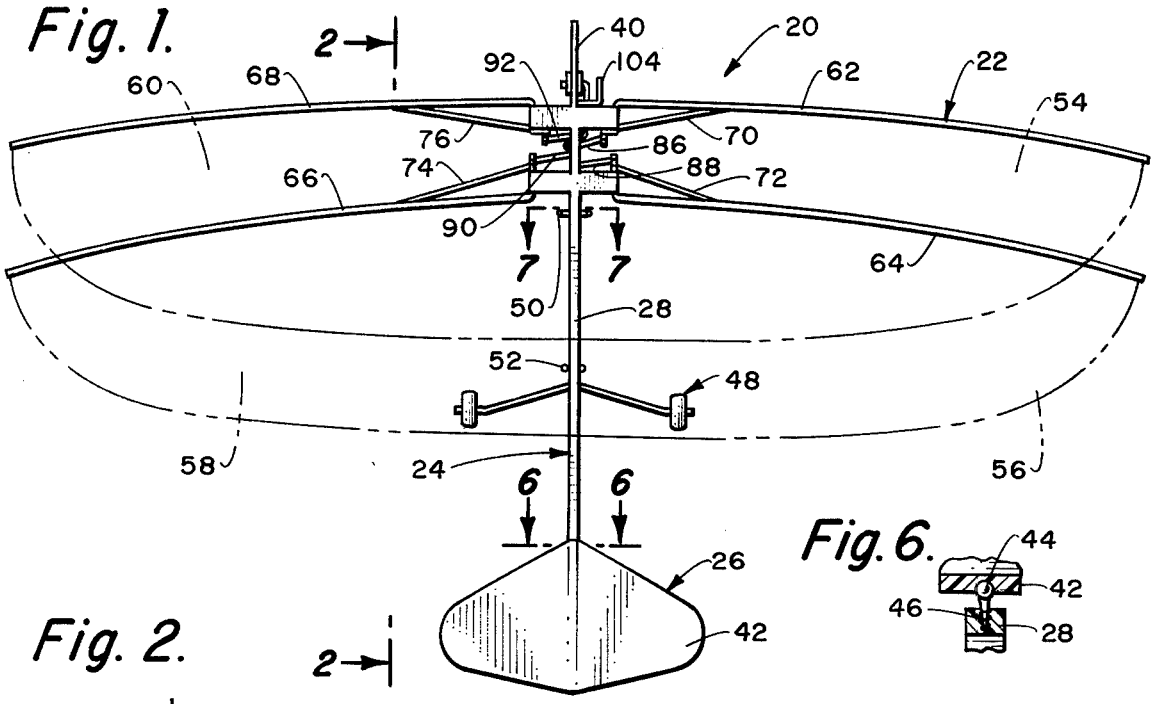
Fig. 6.
Fig. 2.
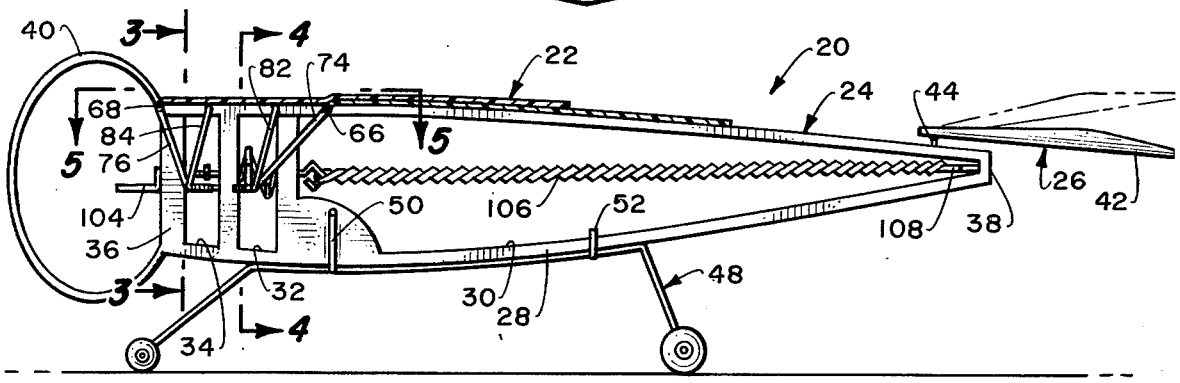
Fig. 3.
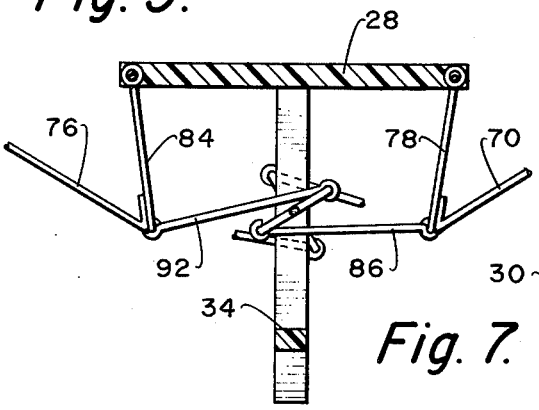
Fig. 4.
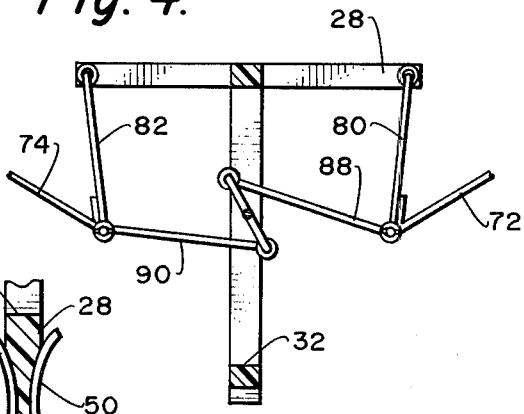
Fig. 7.
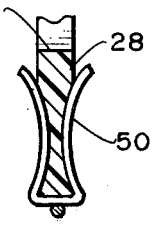

TOY AIRPLANE

BACKGROUND OF THE INVENTION

The field of this invention relates to toys and more particularly to a motorized toy airplane.

There is a wide variety of toy airplanes, such as hand launch gliders, gas operated planes, and so forth. These types of planes are what are commonly termed fixed-wing aircraft.

However, there are known movable-wing aircraft in which the flight of the airplane is produced by the flapping of the wings. This type of aircraft is referred to generally as an ornithopter. In the past, these movable-wing aircraft have employed only a single wing on each side of the fuselage and the flapping motion is produced through a crank assembly. Normally, the motive force supplied to the wing takes the form of a tightened rubberband.

In the operation of the previously known type of movable-wing aircraft, the force from the band is transmitted to the wings in an uneven manner due to the crank assembly. The main component of the force is transmitted to the wing as the wing is moved between the top dead center and the bottom dead center position of the wing. Because of this inherent uneven torque transfer to the wings, the wings are moved in a jerking manner. Not only does this type of movement produce a rapid noise pattern, but also produces very poor flight characteristics of the airplane. Actually, prior to the subject matter of this invention, the flying for any distance of a movable wing type of airplane toy was just unheard of.

SUMMARY OF THE INVENTION

The subject of this invention is summarily described in the Abstract Of The Disclosure and reference is to be had thereto.

The primary objective of this invention is to construct a movable wing aircraft which has most satisfactory flight characteristics.

A further objective of this invention is to construct the airplane of few parts therefore permitting the airplane to be manufactured and sold inexpensively.

Another objective of this invention is that the airplane can be operated by a person quite unskilled in the operation of toy airplanes.

BRIEF DESCRIPTION OF THE DRAWINGS

FIG. 1 is a plan view of the first embodiment of airplane of this invention;

FIG. 2 is a side view, partly in cross-section, taken along line 2—2 of FIG. 1;

FIG. 3 is a cross-sectional view taken along line 3—3 of FIG. 2;

FIG. 4 is a cross-sectional view taken along line 4—4 of FIG. 2;

FIG. 6 is an enlarged cross-sectional view showing the interconnection between the tail and the fuselage;

FIG. 7 is a cross-sectional view showing the connection of the wheel assembly to the fuselage taken along line 7—7 of FIG. 1;

DETAILED DESCRIPTION OF THE SHOWN EMBODIMENT

Figure 5:
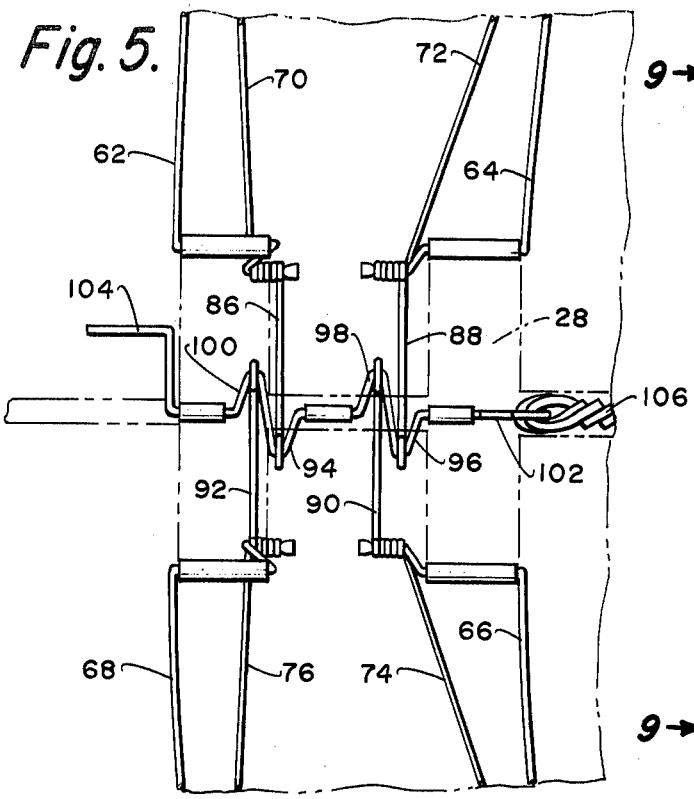
FIG. 5 is a partial plan view taken along line 5—5 of FIG. 2.

Referring particularly to the drawings, there is shown in FIG. 1 the first embodiment 20 of airplane of this invention. Generally, the airplane 20 is composed of wing assembly 22, a fuselage assembly 24 and a tail assembly 26.

The fuselage assembly 24 is composed primarily of an open frame member 28. The open frame member 28 includes an enlarged elongated compartment 30, forward of which is located smaller compartments 32 and 34. The frame 28 includes a front end 36 and a rear end 38.

Attached to the front end 36 is a shock absorbing ring 40 which is to be composed of a wood or plastic material and has the function of damping any frontal force that the airplane might receive in contacting a fixed solid object. The ring 40 may be constructed of any rigid material, such as plastic or wood and the same holds true for the frame 28 as well as the other rigid components of the airplane.

Fixedly secured adjacent the back end 38 is the tail section 26 which takes the form of a butterfly shaped tail member 42. The tail member 42 will normally be formed of some type of rigid material, such as styrofoam or the like. The tail member 42 is to be adjustably movable in respect to the frame 28 so as to vary the flight characteristics of the airplane 20. In order to accomplish this adjustability, the tail member 42 is movably mounted to a limited extent upon a ball 44. The ball 44 is fixedly secured to a fastener section 46 which, in turn, is fixedly secured within the frame 28. The function of the ball 44 permits vertical pivoting movement of the member 42 such as depicted between the solid and phantom lines within FIG. 2. There is also permitted a certain amount of canting movement of the member 42, as well as a limited amount of horizontal movement.

The airplane 20 may be used in a manner to land after it is flown on the frame member 28. However, it is considered to be within the scope of this invention to attach a wheel assembly 48 to the frame 28. This attachment of wheel assembly 48 is by means of spring clips 50 and 52 to the frame 28. By the using of spring clips 50 and 52, the wheel assembly 48 can be readily detached, if desired.

The wing assembly 22 includes two separate wings which are mounted in an overlapping arrangement on the upper surface of the frame 28. The two separate wings are divided into four wing sections 54, 56, 58 and 60. The wing sections 56 and 58 comprise one wing member and is mounted beneath the wing which is formed of wing sections 54 and 60. The wing sections 54, 56, 58 and 60 are basically each of the same size and are generally formed of a thin sheet material, such as "Mylar" or a thin plastic. The cellophane material for each wing section at its leading edge is attached to a wire rod with the wire rods for the wing sections 54, 56, 58 and 60 being respectively 62, 64, 66 and 68. Each of the wire rods 62, 64, 66 and 68 are pivotly secured to a portion of the fuselage frame 28. The wing sections 54, 56, 58 and 60 are attached to the upper surface of the frame 28. This means that by pivoting of the rods 62, 64, 66 and 68, the wing sections 54, 56, 58 and 60 assume a flapping motion.

Secured to each of the rods 62, 64, 66 and 68 is a respective brace rod 70, 72, 74 and 76. The brace rods 70, 72, 74 and 76 are connected, respectively, to a second brace rod 78, 80, 82 and 84. The free ends of the second brace rods 78, 80, 82 and 84 are pivotly connected to the frame 28 of the fuselage.

Adjacent the junction of the rods 70 and 78, there is attached one end of a drive rod 86. Similar drive rods 88, 90 and 92 are respectively secured to the junction of the rods 72 and 80, 74 and 82, and 76 and 84. Drive rod 86 is pivotly secured to a crank arm 94. Drive rod 88 is pivotly secured to a crank arm 96. Drive rod 90 is pivotly secured to a crank arm 98 and drive rod 92 is pivotly secured to a crank arm 100. The crank arms 96, 98, 94 and 100 are formed as part of drive shaft 102. Shaft 102 is pivotly secured to a portion of the frame 28. Crank arms 96, 98, 94 and 100 are integrally formed as part of the shaft 102 but extending therefrom. Crank arms 94 and 100 are in one plane with crank arms 96 and 98 being in another plane which is ninety degrees displaced from the plane of crank arms 94 and 100. The forward end of the crank shaft 102 is formed into a winding handle 104. The rear end of the shaft 102 is fixed to an elastic rubberband 106. The rubberband 106 extends through enlarged compartment 30 and is affixed by bracket 108 to the rearwardmost part of the frame 28. It is to be noted that the preferable form of shape for each of the crank arms 94, 96, 98 and 100 is substantially a V-shape. This facilitates operation of the airplane of this invention.

The operation of the airplane 20 is as follows: The operator grasps the airplane and proceeds to turn the winding handle 104 in either a clockwise direction or counterclockwise direction until the elastic band 106 is quite taut. The operator then releases the airplane 20 and in the process of unwinding the band 106 the arrangement between the crank arms and their drive rods cause the wing sections 54, 56, 58 and 60 to flap. As the wing sections 54 and 60 move in a downward direction the wing sections 56 and 58 move in an upward direction. At the time, sections 54 and 60 reach the bottom dead center position, the sections 56 and 58 still continue to move in the upward direction. The reason for this is that the crank arms 96 and 98 are located in substantially a vertical position while the crank arms 94 and 100 are located in a substantially horizontal position. During the next ninety degrees in movement of the crank arms to where the horizontal and vertical positions both are reversed, the sections 56 and 58 are not located in the top dead center position and the sections 54 and 60 are moving in the upward position. The net result is that there is a continuous flapping motion of the wing sections of the airplane 20 which substantially enhances the flight characteristics of the airplane. Additionally, because of the equal displacing of the planes of the crank arms ninety degrees with respect to each other, the torque being supplied to the wing sections is substantially constant. Therefore, there is no "snap" produced as with a single wing type of airplane of this type. In other words, the total operation of the airplane is substantially smoother with also the flight being significantly enhanced with the airplane flying at a constant smooth rate through the air.

If by flying of the airplane 20, it is discovered that the airplane tends to fly into the ground or tends to fly into a climb, the flight can be adjusted by appropriate adjustment of the tail member 42. Adjustment of the tail member 42 can also be used to effect right and left turns.

Figure 8:
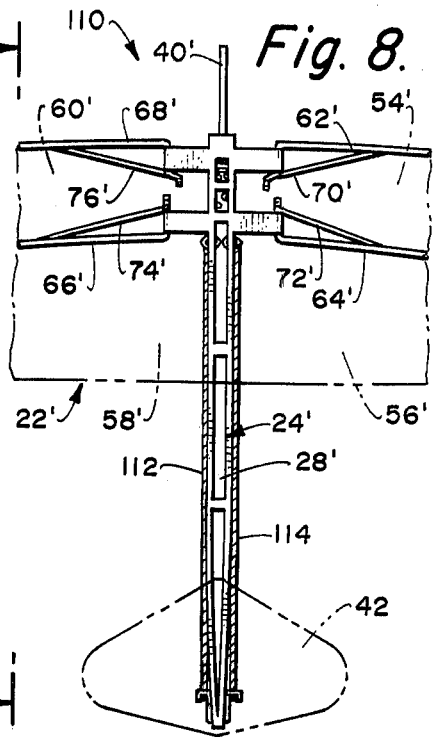
FIG. 8 is a partial plan view of a second embobiment of airplane of this invention.
Figure 9:
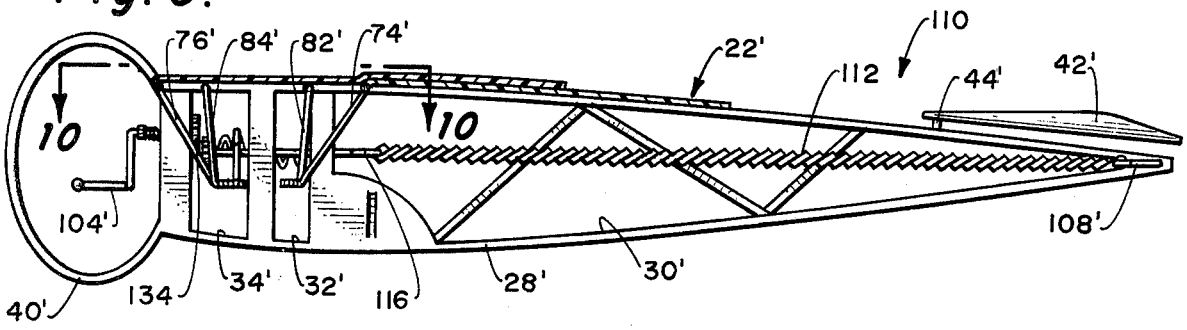
FIG. 9 is a side view of the second embodiment of airplane of this invention taken along line 9—9 of FIG. 8.
Figure 10:
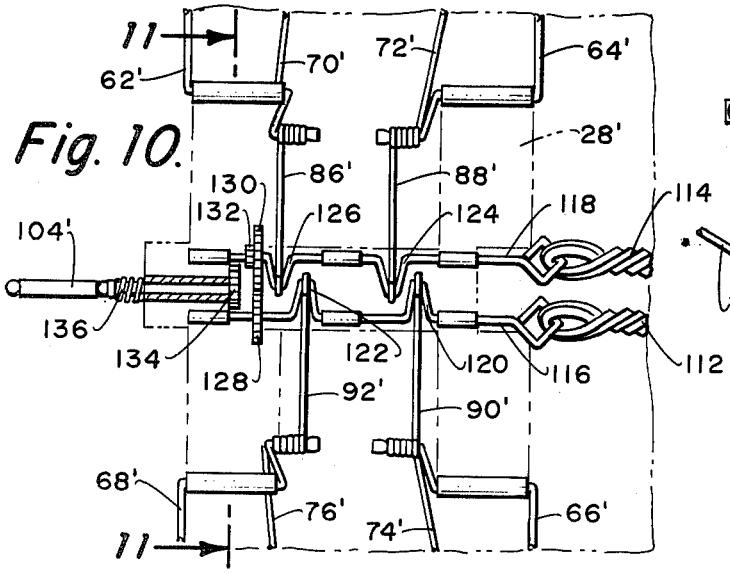
FIG. 10 is a partial plan view of the second embodiment of this invention taken along line 10—10 of FIG. 9.
Figure 11:
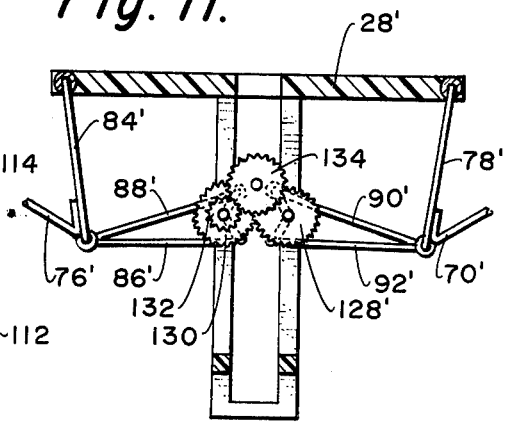
FIG. 11 is a view taken along line 11—11 of FIG. 10.

Referring particularly to the second embodiment 110 of this invention which is shown in FIGS. 8 through 11, like numerals have been employed to refer to like parts. It is not believed that a detailed discussion of these like parts is necessary since the discussion previously would apply. It is to be noted, for clarification, that the numerals within the second embodiment 110 have been altered by making the numeral include a prime to differentiate the numeral from the numerals of first embodiment 20. An inherent disadvantage of the first embodiment 20 is that there is only a single elastic band 106. This means that as the band becomes quite taut, there is a certain amount of torque tending to slightly twist the frame 28. Within the embodiment 110, this is compensated for by the employing of dual elastic bands 112 and 114. The elastic band 112 connects with a first drive shaft 116 with elastic band 114 connecting with a second drive shaft 118. Integrally formed on the drive shaft 116 are crank arms 120 and 122. The plane of the crank arms 120 and 122 are ninety degrees from each other.

The drive shaft 118 is connected to crank arms 124 and 126. Again, the planes of the crank arms 124 and 126 are ninety degrees displaced from each other. Crank arm 126 is to operate the wing section 54' with the crank arm 122 operating the wing section 60'. The crank arm 124 operates the wing section 56' with the crank arm 120 operating the wing section 58'.

It is to be understood that the drive shafts 116 and 118 are rotatably mounted upon the frame 28'. The forwardmost end of the drive shafts 116 and 118 are respectively secured to meshing gears 128 and 130, respectively. The gears 128 and 130 are of the same size. A first drive gear 132 is fixedly mounted on shaft 118 adjacent the gear 130. A second drive gear 134 is mounted on the handle 104'. The handle 104' extends through an appropriate opening in the frame 28'. A spring 136 is located about the handle 104' and exerts a continuous bias upon the handle to locate the gear 134 in the position shown in FIG. 10 of the drawings. In this position, gear 134 is not engaged with the gear 132.

In order to affect winding of the bands 112 and 114, the operator must pust inward on the handle 104' until gear 134 meshes with gear 132. In this position, at this time, upon winding of the handle 104', the elastic bands 114 and 116 are tightened, but each are tightened in the opposite direction since the shafts 116 and 118 turn in the opposite direction. Therefore, as a result of the overall structure of the plane 110, the torque of the bands 112 and 114 balance themselves out with respect to the fuselage 28 and 24'. Therefore, there is no tendency to slightly cock the rear portion of the fuselage with respect to the front portion of the fuselage. Therefore, an even truer flight characteristic should be achieved with the airplane embodiment 110.

There is a possibility within the airplane 20 of winding the elastic band 106 from the rear portion of the plane as opposed to the front portion of the plane. If this were to occur, a small lever would be actuated to hold the cranks 96, 98, 94 and 100 stationary with respect to the frame 28. There would be incorporated a simple ratchet device within the tail portion of the frame 28 which would permit rotation of the ratchet device in only a single direction. The primary advantage of this arrangement would be that the elastic band 106 can be wound much more easily since the wing sections wouldn't flap while the winder is being turned. It is to be noted that this type of winding device could not be used upon the airplane embodiment 110.

What is claimed is:

1. A toy airplane comprising:

a fuselage;

a first pair of wings mounted on one side of said fuselage, a second pair of wings mounted on the opposite side of said fuselage, said wings to be movable in a flapping manner, both said first pair and second pair of wings comprise two separate wings located in an overlapping manner;

each said wing being drivingly connected to a crank arm with there being four in number of crank arms, each said crank arm being located in a specific plane, said crank arms being rotatably mounted upon said fuselage; and motor means mounted upon said fuselage, said motor means to rotate said crank arms.

2. The airplane as defined in claim 1 wherein:

said crank arms being fixed to a single drive shaft, said motor means being connected to said drive shaft to rotate such, said crank arms being divided into a first pair of crank arms and a second pair of crank arms, said first pair of crank arms located in a first plane, said second pair of crank arms located in a second plane, said first pair of crank arms to operate the upper wings of each said pair of wings, said second pair of crank arms to operate the lower wings of each said pair of wings, said first plane being angularly displaced in respect to said second plane.

3. The airplane as defined in claim 2 wherein:

said first plane being displaced ninety degrees from said second plane.

4. The airplane as defined in claim 3 including:

a tail mounted on said fuselage, said tail being capable of being adjusted to different positions to vary the flying characteristics of said airplane.

5. The airplane as defined in claim 3 wherein:

said motor means including a single elongated rubberband.

6. The airplane as defined in claim 1 wherein:

said first pair of crank arms being attached to a first drive shaft, said second pair of crank arms being attached to a second drive shaft, said first pair of crank arms to operate said first pair of wings, said second pair of crank arms to operate said second pair of wings, the planes of each of the cranks of said first pair of cranks being angularly displaced relative to each other, the planes of each of the cranks of said second pair of cranks being angularly displaced relative to each other.

7. The airplane as defined in claim 6 wherein:

the angular displacement between the cranks of each said pair of cranks being ninety degrees.

8. The airplane as defined in claim 7 including:

said first and said second drive shafts being geared together to rotate at the same rotational speed but in opposite directions.

9. The airplane as defined in claim 8 wherein:

a tail mounted on said fuselage, said tail being capable of being adjusted to different positioned to vary the flying characteristics of said airplane.

10. The airplane as defined in claim 9 wherein:

said motor means comprising a pair of elongated rubberbands with a said rubberband to connect with said first shaft and the other of said rubberbands to connect with said second shaft.

* * * * *